US006644077B1

(12) United States Patent
Huang

(10) Patent No.: US 6,644,077 B1
(45) Date of Patent: Nov. 11, 2003

(54) LOCK STRUCTURE FOR BATHROOM USE

(75) Inventor: Chao-Ming Huang, Kaohsiung Hsien (TW)

(73) Assignee: Taiwan Fu Hsing Industrial Co., Ltd., Kaohsiung Hsien (TW)

( * ) Notice: Subject to any disclaimer, the term of this patent is extended or adjusted under 35 U.S.C. 154(b) by 0 days.

(21) Appl. No.: 10/373,847

(22) Filed: Feb. 27, 2003

Related U.S. Application Data

(63) Continuation-in-part of application No. 10/173,687, filed on Jun. 18, 2002.

(30) Foreign Application Priority Data

May 31, 2002 (TW) ..... 91208204 U
Dec. 24, 2002 (TW) ..... 91221245 U

(51) Int. Cl.[7] ..... E05B 55/04

(52) U.S. Cl. ..... 70/468; 292/358; 292/359; 70/472; 70/477; 70/489

(58) Field of Search ..... 70/468, 462, 471, 70/482, 477, 479, 480, 481, 483, 489, 149; 292/357–359, DIG. 24

(56) References Cited

U.S. PATENT DOCUMENTS 4,861,084 A * 8/1989 Ozagir et al. ..... 292/359
4,866,965 A * 9/1989 Urdal ..... 70/481
4,920,773 A * 5/1990 Surko, Jr. ..... 70/224
5,286,074 A * 2/1994 Lin ..... 292/336.3
5,484,177 A * 1/1996 Fortune et al. ..... 292/140
5,505,508 A * 4/1996 Kuo ..... 292/359
5,562,317 A * 10/1996 Kuo et al. ..... 292/359
5,636,882 A * 6/1997 Hook ..... 292/359
5,826,924 A * 10/1998 Huang ..... 292/359
5,881,586 A * 3/1999 Shen ..... 70/107
6,178,795 B1 * 1/2001 Hsueh ..... 70/472
6,286,347 B1 * 9/2001 Frolov ..... 70/472
6,568,231 B1 * 5/2003 Huang ..... 70/468

* cited by examiner

*Primary Examiner*—Anthony Knight
*Assistant Examiner*—John B. Walsh
(74) *Attorney, Agent, or Firm*—Bacon & Thomas, PLLC

(57) ABSTRACT

An inner unlatching mechanism for a bathroom lock includes an inner unlatching rod, a fixing member, a locking wheel, and a follower wheel. The fixing member is fixed to an inner rose and mounted around the inner S unlatching rod. A truncated conic unlatching groove and a locking groove are defined in a side of the fixing member. The locking groove has a depth rod not equal to that of the unlatching groove. When an inner handle is turned to turn an inner spindle through 40–60 degrees, an engaging block of the locking wheel is moved into the unlatching groove of the fixing member, and an arcuate drive portion of the locking wheel is disengaged from a notch of the follower wheel, thereby achieving the unlatching function.

8 Claims, 6 Drawing Sheets

LOCK STRUCTURE FOR BATHROOM USE

CROSS REFERENCE TO RELATED APPLICATION

This is a continuation-in-part application of U.S. patent application Ser. No. 10/173,687 filed on Jun. 18, 2002.

BACKGROUND OF THE INVENTION

1. Field of the Invention

The present invention relates to a lock structure for bathroom use. In particular, the present invention relates to a bathroom lock that allows unlatching through rotation of an inner handle through a smaller angle.

2. Description of Related Art

FIG. 1 of the drawings illustrates a conventional lock structure for bathroom use, which is disclosed in U.S. patent application Ser. No. 10/173,687. The lock includes an inner rose 10, an outer rose 20, an inner unlatching mechanism 30, and an outer unlatching mechanism 40. The inner unlatching mechanism 30 allows locking by a user in the bathroom and unlocking by turning of an inner handle 11. When in emergency, one may use a tool to turn the outer unlatching mechanism 40 to achieve the unlocking function.

The inner unlatching mechanism 30 includes an inner unlatching rod 31, a fixing member 32, a locking wheel 33, and an elastic element 34, and a follower wheel 35. The inner unlatching rod 31 is pivotally extended through a hole 32 in the fixing member 32 that is fixed to the inner rose 2. The inner unlatching rod 31 is extended through a non-circular hole 333 of the locking wheel 33 to allow joint rotation of the inner unlatching rod 31 and the locking wheel 33. The fixing member 32 further includes an unlatching notch 322 and a locking notch 323 having a depth not equal to that of the unlatching notch 322.

An engaging block 331 projects from a side of the locking wheel 33. Further, the locking wheel 33 includes annularly arranged teeth 332, in a periphery thereof. When the engaging block 331 is engaged in the unlatching notch 322, the locking wheel 33 is biased by the elastic element 34 such that the teeth 332 of the locking wheel 33 disengage from teeth 352 of the follower wheel 35. When the engaging block 331 is engaged in the locking notch 323, the teeth 332 of the locking wheel 33 are engaged in the notch 351 of the follower wheel 35 such that rotation of the outer handle 21 cannot unlatch the lock and that the lock can be unlatched when the inner handle 11 is turned. The elastic element 34 biases the locking wheel 33 such that locking wheel 33 is always in intimate contact with the fixing member 32 and that the engaging block 331 is selectively engaged in one of the unlatching notch 322 and the locking notch 323. Locking can be achieved by turning the inner unlatching rod 31 through 90 degrees to urge the engaging block 331 of the locking wheel 33 to move into the locking groove 323, and the teeth 332 of the locking wheel 33 are engaged with the notch 351 of the follower wheel 35 while moving the outer unlocking mechanism 40 to a state for preventing rotation of the outer spindle 22 and the outer handle 21.

The user may turn the inner handle 11 through 90 degrees for unlatching the lock. However, in actual use, it has been found that sometimes the unlatching procedure is accomplished through forty-five (45) degree rotation of the inner handle 11, which is particularly true when there is a large gap between the door jamb and the end face of the door facing the door jamb. Thus, it is common that the user turns the inner handle 11 through 45 degrees, opens the door, leaves the bathroom, and closes the door again. However, the teeth 332. of the locking wheel 33 have not disengaged from the notch 351 of the follower wheel 35 yet, as the inner handle 11 is only turned through 45 degrees, not 90 degrees. As a result, the bathroom is inadvertently locked. Further, the teeth 332 of the locking wheel 33 and the teeth 352 of the follower wheel 35 are apt to be bent, deformed, and damaged. The depth of the unlatching notch 322 also decreases strength of the fixing member 32. The service life of the bathroom lock is accordingly shortened.

OBJECTS OF THE INVENTION

An object of the present invention is to provide a bathroom lock that allows unlatching through rotation of an inner handle through a smaller angle, thereby avoiding unintentional locking of the bathroom resulting from previous unlatching by insufficient rotational movement of the inner handle.

Another object of the present invention is to provide a bathroom lock that has a simplified unlatching mechanism for prolonging the service life of the lock.

A further object of the present invention is to provide a bathroom lock with a fixing member having improved strength for prolonging the service life of the lock.

SUMMARY OF THE INVENTION

To achieve the aforementioned objects, the present invention provides a bathroom lock that includes an inner rose, an outer rose, an inner unlatching mechanism, and an outer unlatching mechanism. The inner unlatching mechanism includes an inner unlatching rod, a fixing member, a locking wheel, and a follower plate. The fixing member includes an unlatching groove and a locking groove.

A lock structure for bathroom use in accordance with the present invention comprises an inner rose, an outer rose, an inner unlatching mechanism, and an outer unlatching mechanism. An inner spindle rotatably extends through the inner rose, with an inner handle being attached to the inner spindle to turn therewith. An outer spindle rotatably extends through the outer rose, with an outer handle being attached to the outer spindle to turn therewith. The inner unlatching mechanism comprises an inner unlatching rod, a fixing member, a locking wheel, and a follower wheel.

The inner unlatching rod has a non-circular section and is operably connected to the outer unlatching mechanism. The fixing member is fixed to the inner rose and mounted around the inner unlatching rod. The fixing member includes a first side, a second side, and a central hole through which the inner unlatching rod rotatably extends. An unlatching groove is defined in the first side of the fixing member and tapers to the central through-hole. The unlatching groove is delimited by a truncated conic wall. A locking groove is defined in an end edge of the first side of the fixing member and spaced from the unlatching groove. The locking groove has a depth along a longitudinal direction of the inner unlatching rod not equal to a depth of the unlatching groove along the longitudinal direction of the inner unlatching rod.

The locking wheel is mounted to the inner unlatching rod to turn therewith. The locking wheel includes an engaging block for selectively engaging with one of the unlatching groove and the locking groove of the fixing member. The locking wheel further includes an arcuate drive portion on an outer periphery thereof. The follower wheel is securely mounted around the inner spindle to turn therewith. The follower wheel includes a notch for releasably engaging with the arcuate drive portion of the locking wheel.

When in a locked state, the engaging block of the locking wheel is engaged in the locking groove of the fixing member, and the arcuate drive portion of the locking wheel is engaged in the notch of the follower wheel, with the outer unlatching mechanism being in a state not allowing rotational movement of the outer spindle and the outer handle.

When the inner handle is turned to turn the inner spindle through 40–60 degrees, the engaging block of the locking wheel is moved into the unlatching groove of the fixing member, and the arcuate drive portion of the locking wheel is disengaged from the notch of the follower wheel.

In an embodiment of the invention, the unlatching groove of the fixing member has a width greater than that of the engaging block of the locking wheel, and the unlatching groove of the fixing member has a length greater than that of the engaging block of the locking wheel.

An elastic element is mounted around the inner unlatching rod for biasing the fixing member to press against the inner rose and for biasing the engaging block of the locking wheel to be selectively engaged in one of the unlatching groove and the locking groove of the fixing member. The inner rose includes a hole through which the inner unlatching rod is rotatably extended. A groove is defined in an inner periphery defining the hole of the inner rose. The fixing member further includes a protrusion on the second side thereof. The protrusion of the fixing member is securely engaged in the hole of the inner rose.

The inner unlatching rod has an end extending beyond the inner rose, with an arm being attached to the end of the inner unlatching rod. The locking wheel further includes another arcuate drive portion located on the outer periphery of the locking wheel and diametrically opposed to the arcuate drive portion.

The outer rose has a hole and a pair of plates on both sides of the hole.

The outer unlatching mechanism includes an outer unlatching rod, a stop plate, a locking plate, and a wheel securely mounted to the outer rose to turn therewith and having an engaging groove.

The outer unlatching rod extends through the hole of the outer rose and has a non-circular hole for securely receiving an end of the inner unlatching rod to turn therewith. The outer unlatching rod further has a drive portion located outside a door to which the lock structure is mounted so that the drive portion is drivable by a tool to turn the outer unlatching rod for unlatching.

The stop plate is mounted on the outer unlatching rod and slidable yet not rotatable along a longitudinal axis of the outer unlatching rod. The stop plate is located between the plates of the outer rose and has a protrusion and a hole through which the outer unlatching rod extends.

The locking plate is mounted to the outer unlatching rod to turn therewith. The locking plate has a locking groove having a depth along a longitudinal axis of the outer unlatching rod and an unlatching groove having a depth along the longitudinal axis of the outer unlatching rod not equal to the depth of the locking groove of the locking plate. The protrusion of the stop plate is selectively engaged in one of the locking groove and the unlatching groove of the locking plate.

When in the locked state, the protrusion of the stop plate is engaged in the locking groove of the locking plate, and the stop plate is engaged in the engaging groove of the wheel. When the inner handle is turned for unlatching purposes, the locking plate is so turned that the protrusion of the stop plate is moved into the unlatching groove of the locking plate and that the stop plate is engaged from the engaging groove of the wheel, allowing free rotation of the outer spindle and the outer handle.

The fixing member may further have another locking groove defined in another end edge of the first side of the fixing member that is opposed to the end edge of the first side of the fixing member.

Other objects, advantages and novel features of this invention will become more apparent from the following detailed description when taken in conjunction with the accompanying drawings.

DETAILED DESCRIPTION OF THE PREFERRED EMBODIMENT

The present invention is now to be described hereinafter in detail, in which the same referential numerals are used for the same parts as those in the prior art.

Figure 2:
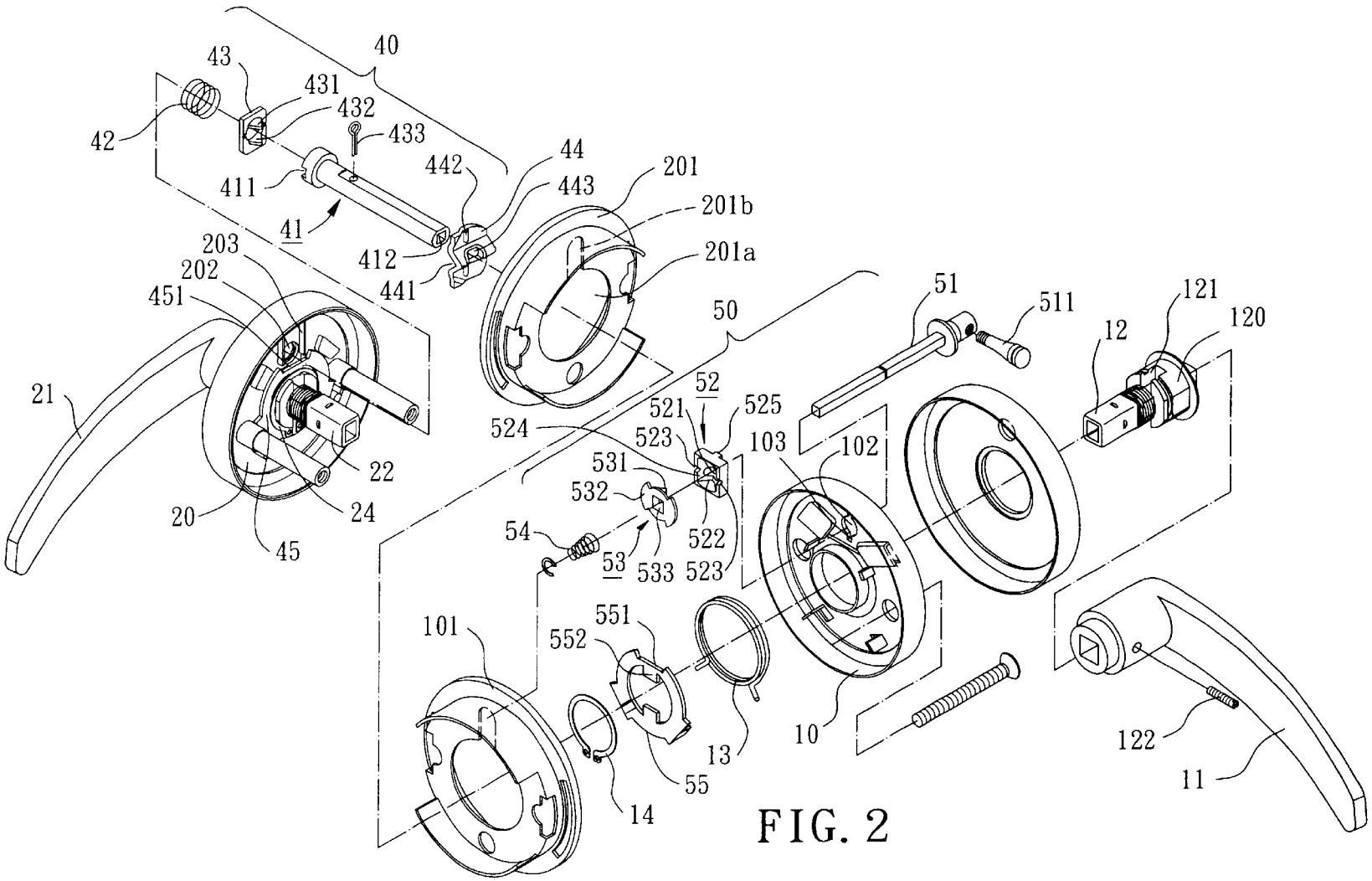
FIG. 2 is an exploded perspective view of a lock structure for bathroom use in accordance with the present invention.
Figure 3:
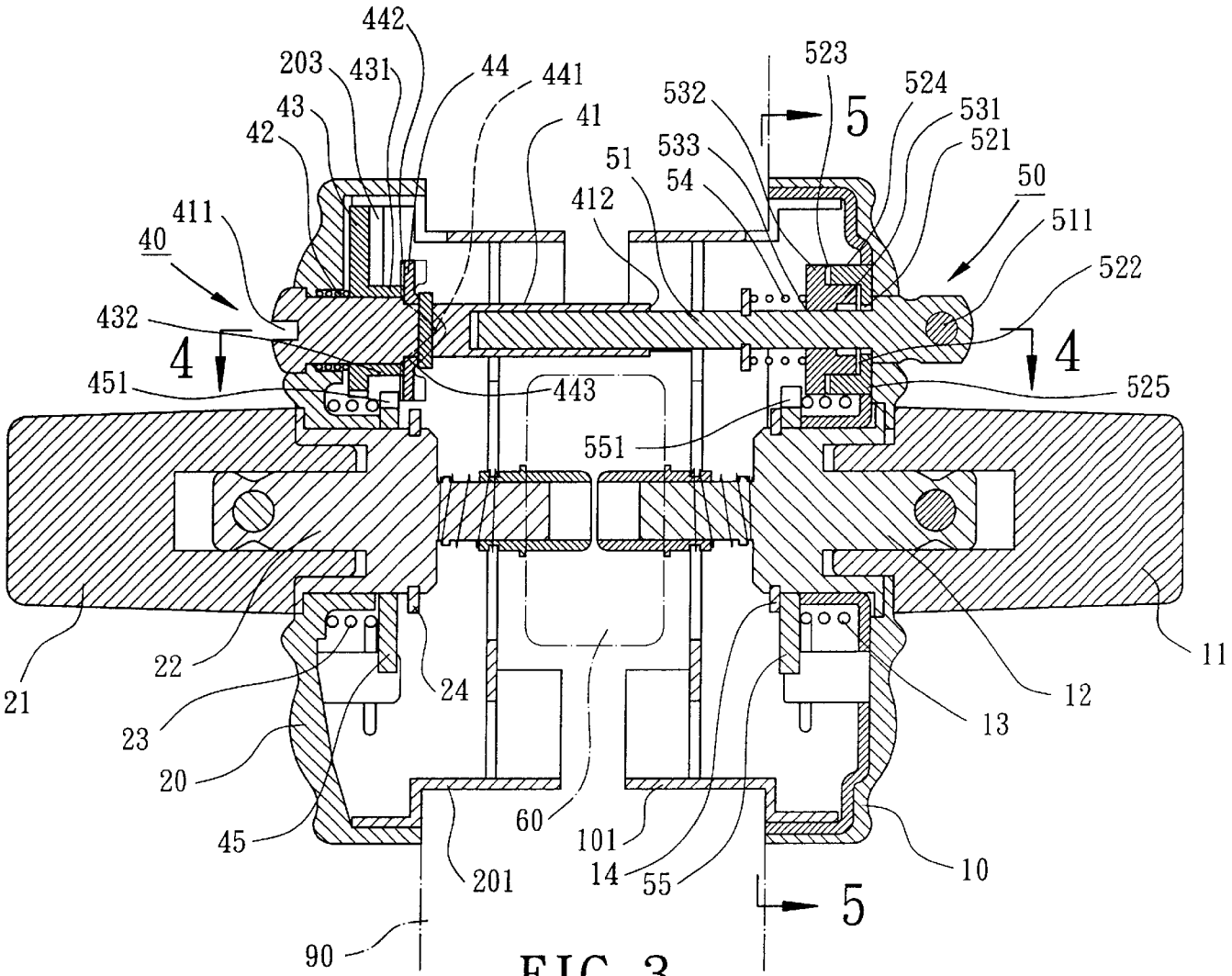
FIG. 3 is a sectional view of the lock structure in FIG. 2, wherein the lock is in an unlocked state.

Referring to FIGS. 2 and 3, a bathroom lock in accordance with the present invention comprises an inner rose 10, an outer rose 20, an inner unlatching mechanism 50, and an outer unlatching mechanism 40. Each latching mechanism 40, 50 also serves the latching function.

The outer rose 20 is mounted to an outer side of a door 90. An outer handle 21 is pivotally mounted to the outer rose 20 and engaged with an outer spindle 22, allowing joint rotation of the outer handle 21 and the outer spindle 22. A wheel 45 is mounted on the outer spindle 22 to turn therewith. The wheel 45 includes an engaging groove 451 in a periphery thereof. Further, a pair of plates 203 project from an inner side of the outer rose 20, with a hole 102 being defined in the outer rose 20 and located between the plates 203. An outer housing 201 is attached to the inner side of the outer rose 20 and includes a hole 201*a* through which the outer spindle 22 extends and a slot 201*b* through which an outer unlatching rod 41 of the outer unlatching mechanism 4 extends.

The inner rose 10 is engaged with the outer rose 20 in a conventional manner such that the inner rose 10 and the outer rose 20 are respectively mounted to the inner side and the outer side of the door 90. The inner rose 10 is engaged with an inner housing 101. An inner handle 11 is pivotally mounted to the inner rose 1 and engaged with an inner spindle 12 by a fastener 122, allowing joint rotation of the inner handle 11 and the inner spindle 12.

A follower wheel 55 of the inner unlatching mechanism 50 and a drive wheel 120 are mounted on the inner spindle 12 to turn therewith. The drive wheel 120 in this embodiment is integrally formed with the inner spindle 12. A retainer ring 14 is provided to prevent disengagement of the drive wheel 120 and the follower wheel 55. Further, an elastic element 13 for returning the inner handle 11 is mounted in the inner rose 10. Turning either handle 11, 21 causes retraction of a latch bolt 60 (FIG. 3).

The inner unlatching mechanism 50 includes an inner unlatching rod 51, a fixing member 52, a locking wheel 53, and the follower wheel 55 mentioned above. The fixing member 52 includes an unlatching groove 522 and at least one locking groove 523. In this embodiment, the fixing member 52 includes an unlatching groove 522 defined in a first side thereof and a protrusion 525 on a second side thereof. The inner unlatching rod 51 extends through a hole 102 in the inner rose 10. An arm 511 is attached to an end of the inner unlatching rod 51 that extends beyond the inner rose 10. The fixing member 52 is fixed on the inner rose 10 by mean of engaging the protrusion 525 with a groove 103 defined in an inner periphery defining the hole 102 of the inner rose 10. Thus, mounting of the fixing member 52 is simplified. Further, the fixing member 52 is biased by an elastic element 54 mounted around the inner unlatching rod 51 to firmly press against the inner rose 10. The unlatching groove 522 is delimited by a truncated conic wall 524 that tapers to a central through-hole 521 of the fixing member 52. Two locking grooves 523 are defined in two opposed end edges of the first side of the fixing member 52 that are spaced by the truncated conic unlatching groove 522. It is noted that only one locking groove 523 is sufficient to achieve the required locking function, and the description hereinafter will be made with only one locking groove 523. The locking groove 523 has a depth (i.e., axial length along the longitudinal axis of the inner unlatching rod 51) smaller than a depth (i.e., axial length along the longitudinal axis of the inner unlatching rod 51) of the unlatching groove 522. The follower wheel 55 includes a notch 551 in an outer periphery thereof and a pair of diametrically disposed protrusion 552 on an inner periphery thereof. The protrusions 552 of the follower wheel 55 are engaged with grooves 121 of the drive wheel 120 to turn therewith.

Figure 1:
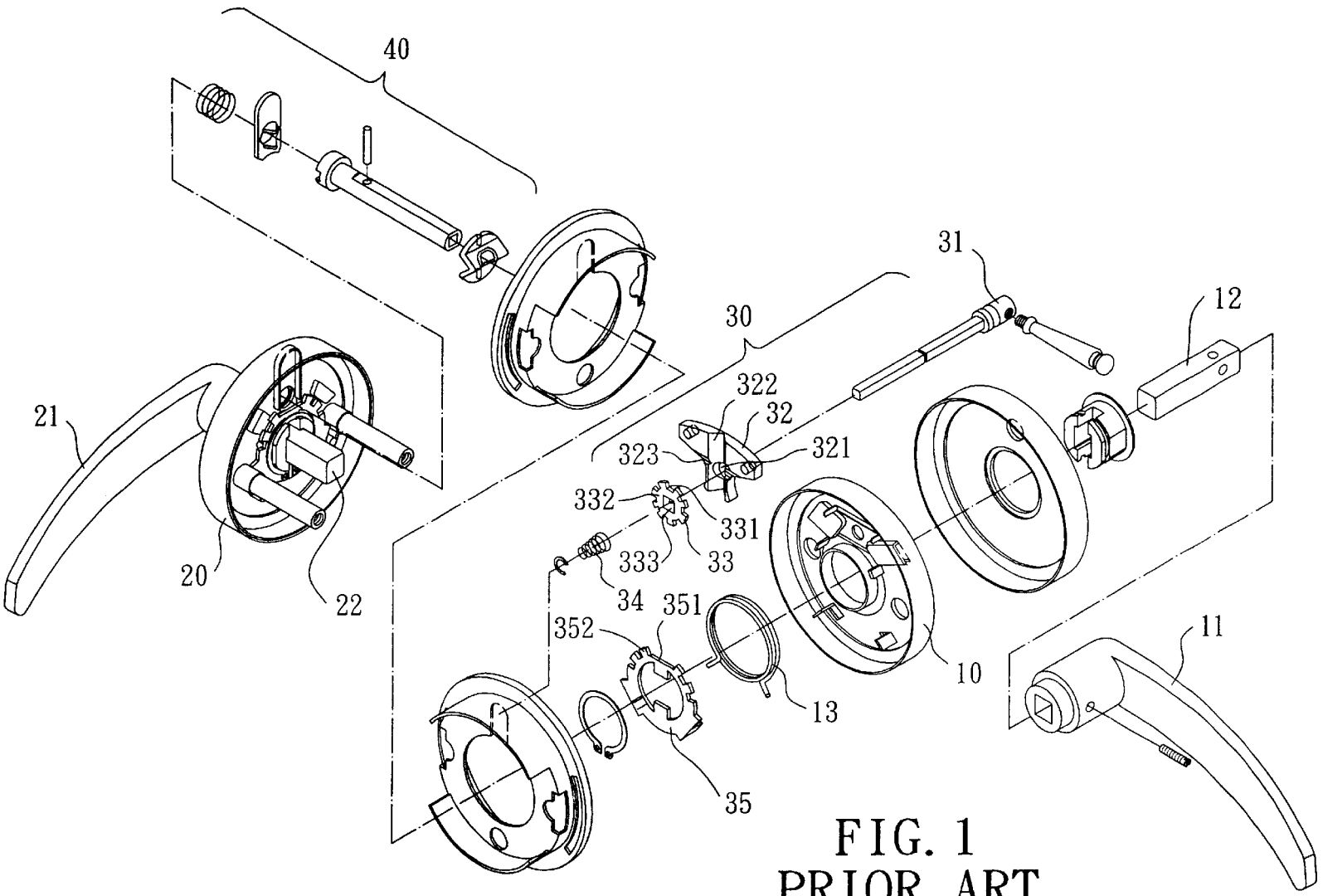
FIG. 1 PRIOR ART
FIG. 1 is an exploded perspective view of a conventional lock structure for bathroom use.

The locking wheel 53 includes a non-circular hole 533 through which the inner unlatching rod 51 extends. Formed on a side of the locking wheel 53 is an engaging block 531 that is selectively engaged in one of the unlatching groove 522 and the locking groove 523. Further, the locking wheel 53 includes two diametrically disposed arcuate drive portions 532 on an outer periphery of the locking wheel 53. In comparison to the conventional design shown in FIG. 1, the structure of the bathroom lock in accordance with the present invention is simplified, as the teeth 352 on the follower wheel 35 of the conventional design are omitted, and the teeth 332 of the locking wheel 33 of the conventional design are replaced with two arcuate drive portions 552 on the outer periphery of the follower wheel 55 in the present invention. Thus, in a case that one of the arcuate drive portion 532 of the locking wheel 53 is engaged with the notch 551 of the follower wheel 55, when the engaging block 531 of the locking wheel 53 is turned through 90 degrees and moves from the unlatching groove 522 to the locking groove 523 of the fixing member 52, the locking wheel 53 moves leftward (when viewed from the direction of FIG. 3) and is thus disengaged from the notch 551 of the follower wheel 55, thereby achieving the unlatching function. The two diametrically disposed arcuate drive portions 532 allow the lock to be used with either a left-handed door or a right-handed door without adjustment of the inner unlatching mechanism 50. Further, the arcuate drive portions 532 improve the strength of the locking wheel 53 and lower the risk of deformation and damage after long-term use of the lock.

The outer unlatching mechanism 40 includes an outer unlatching rod 41, an elastic element 42, a stop plate 43, a locking plate 44, and the above-mentioned wheel 45. The outer unlatching rod 41 is pivotally extended through the hole 202 of the outer rose I and includes an end engaged with the inner unlatching rod 51 of the other end of the inner unlatching mechanism 50 through a non-circular section. For example, the inner unlatching rod 51 is rectangular and engaged in a rectangular hole 412 in the outer unlatching rod 41. The other end of the outer unlatching mechanism 41 includes a drive portion 411 that is exposed outside the outer rose 20. When in emergency, the outer unlatching rod 41 can be turned by turning the drive portion 411. The drive portion 411 may be a slot (not labeled), as shown in FIG. 2.

The locking plate 44 includes a locking groove 441 and an unlatching groove 442 that is shallower than the locking groove 441. The stop plate 43 includes a protrusion 431 and a hole 432 through which the outer unlatching rod 41 extends. The elastic element 42, the stop plate 43, and the locking plate 44 are mounted in sequence around the outer unlatching rod 41, and a retaining member, e.g., a pin 433 is provided to retain the locking plate 44 on the outer unlatching rod 41. The stop plate 43 and the outer unlatching rod 41 may rotate relative to each other, but the locking plate 44 and the outer unlatching rod 41 turns jointly. In this embodiment, the outer unlatching rod 41 includes a non-circular outer periphery, and the locking plate 44 includes a non-circular hole 443 through which the outer unlatching rod 41 extends. The stop plate 43 and the locking plate 44 are biased by the elastic element 42 such that the stop plate 43 is always in intimate contact with the locking plate 44. The stop plate 43 may slide along a longitudinal axis of the outer unlatching rod 41 such that the stop plate 43 is releasably engaged with the engaging groove 451 of the wheel 45 when in a locking state, thereby preventing rotational movement of the outer handle 21 and the outer spindle 22.

It is noted that the depth (i.e., axial length) of the locking groove 441 of the locking plate 44 is different from the depth (i.e., axial length) of the unlatching groove 442 of the locking plate 44 and that the locking plate 44 and the outer unlatching rod 41 turn jointly. Further, the unlatching groove 522 of the fixing member 52 has a width greater than that of the engaging block 531 of the locking wheel 53, and the unlatching groove 522 of the fixing member 52 has a length greater than that of the engaging block 531 of the locking wheel 53.

When in a locked state, the protrusion 431 of the stop plate 43 is engaged in the locking groove 441 of the locking plate 44. During unlatching operation, the locking plate 44 is turned through 90 degrees to move the protrusion 431 of the stop plate 43 into the unlatching groove 442 of the locking plate 44. Thus, the stop plate 43 is disengaged from the engaging groove 45 of the wheel 45 to allow free rotation of the outer spindle 22 and the outer handle 21.

Figure 4:
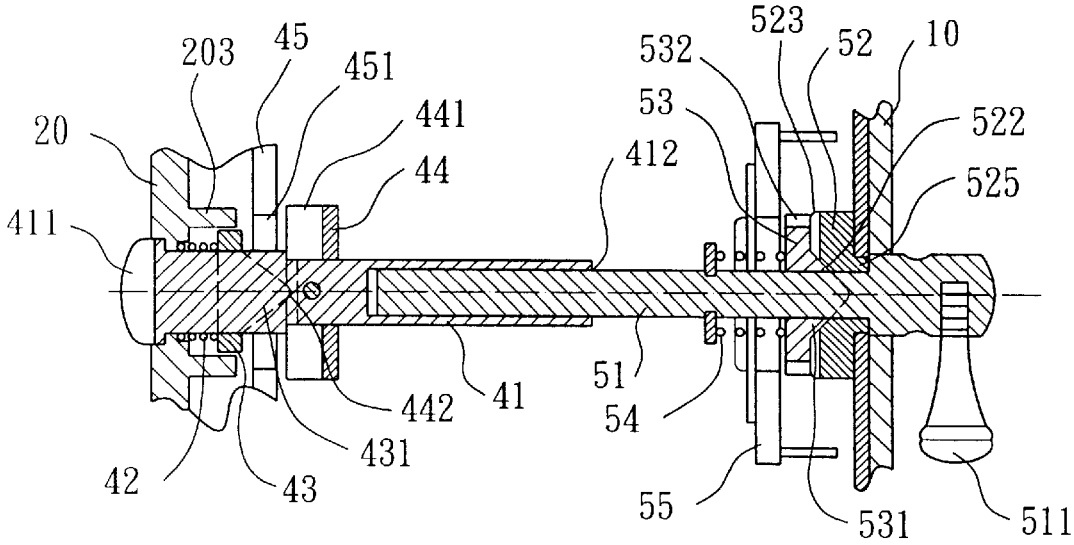
FIG. 4 is a sectional view taken along plane 4—4 in FIG. 3.
Figure 5:
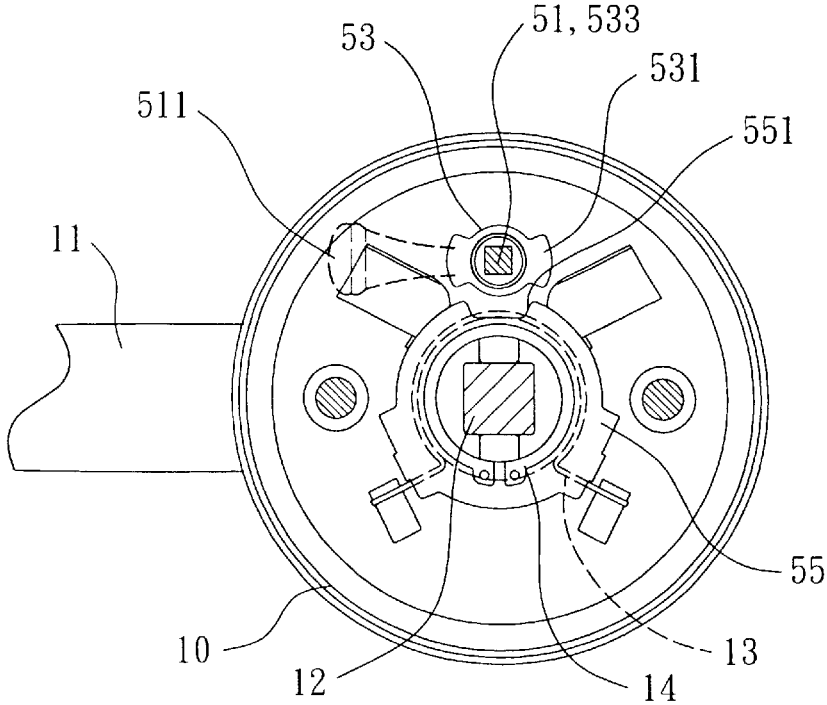
FIG. 5 is a sectional view taken along plane 5—5 in FIG. 3.

Referring to FIGS. 3 through 5, when in an unlocked state, the engaging block 531 of the locking wheel 53 is engaged in the unlatching groove 522 of the fixing member 52, and none of the arcuate drive portions 532 of the locking wheel 53 is engaged in the notch 551 of the follower wheel 55. Further, the protrusion 431 of the stop plate 43 is engaged in the unlatching groove 442 of the locking plate 44, and the stop plate 43 is disengaged from the engaging groove 451 of the wheel 45. In this case, the user may turn either handle 11, 21 to retract the latch bolt 60 for opening the door.

Figure 6:
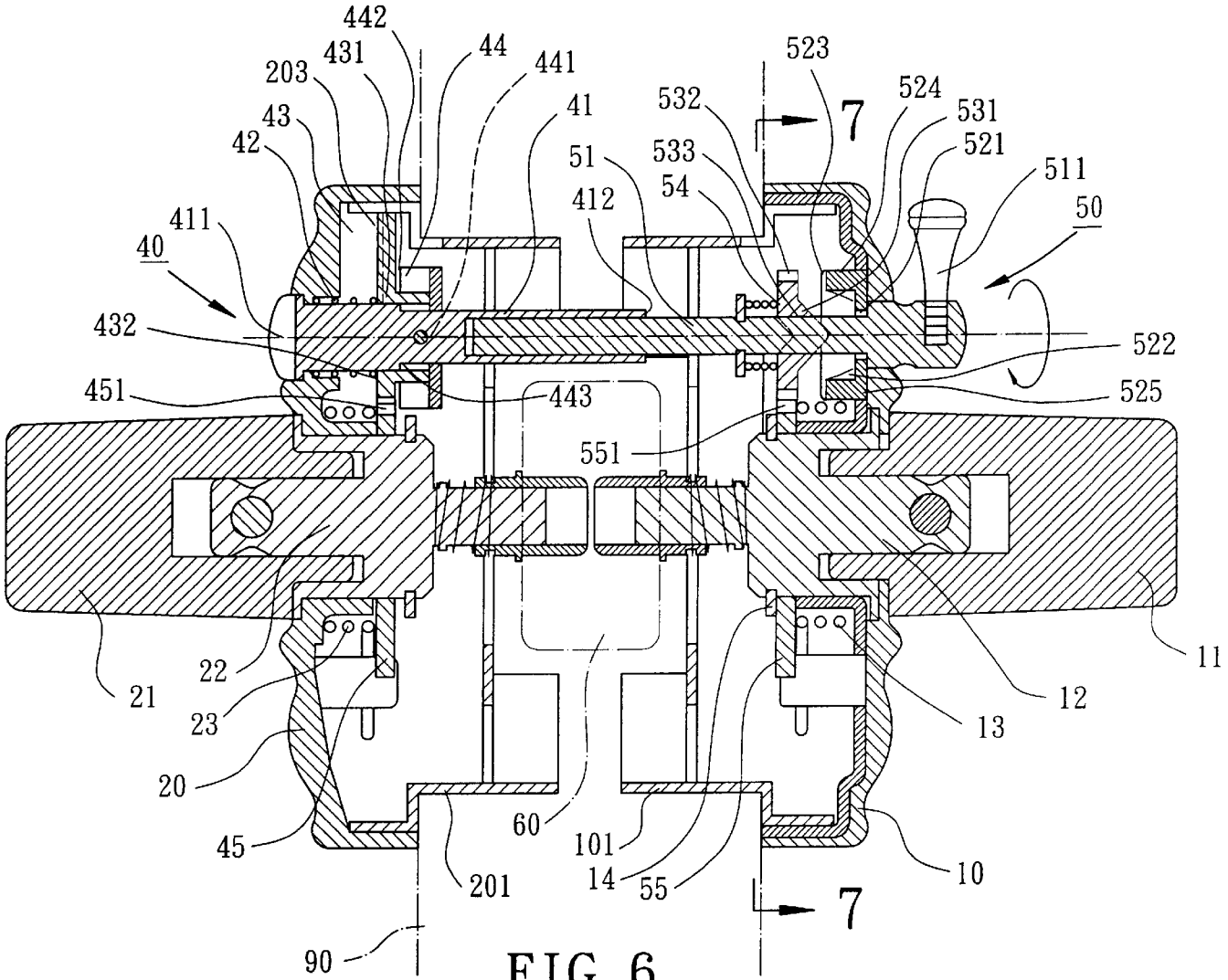
FIG. 6 is a view similar to FIG. 3, wherein the lock is in a locked state.
Figure 7:
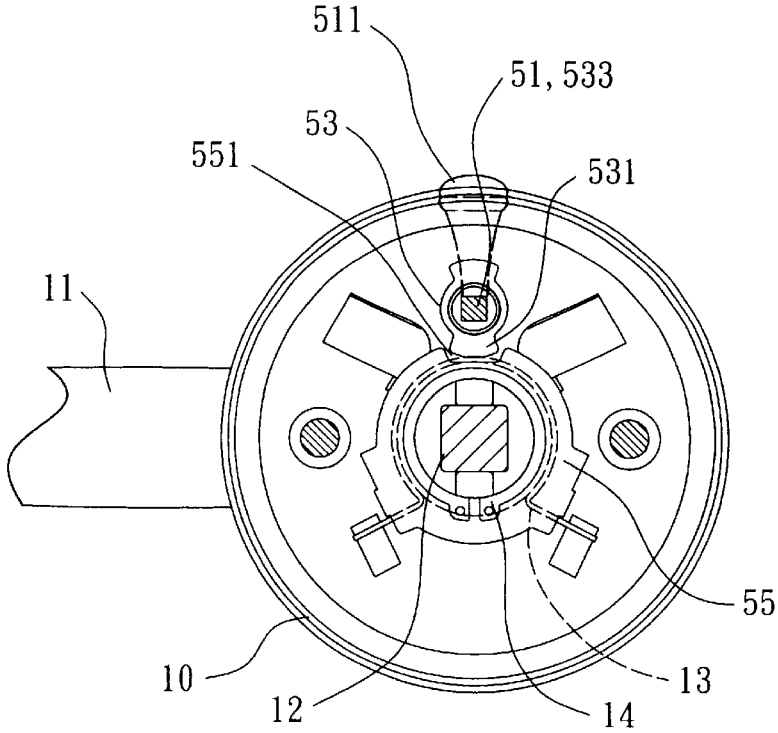
FIG. 7 is a sectional view taken along plane 7—7 in FIG. 6.

Referring to FIGS. 6 and 7, when switching from the unlocked state to a locked state, the user turns the arm 511 attached to an end of the inner unlatching rod 511 through 90 degrees to move the engaging block 531 of the locking wheel 53 into the locking groove 523 of the fixing member 52, and the locking wheel 53 is moved leftward (when viewed from the direction of FIG. 6) until one of the arcuate drive portions 532 of the locking wheel 53 is engaged in the notch 551 of the follower wheel 55. Meanwhile, the locking plate 44 is turned through 90 degrees such that the protrusion 431 of the stop plate 43 is moved into the locking groove 441 of the locking plate 44 and that the stop plate 43 is moved to a position engaged with the engaging groove 451 of the wheel 45. Rotation of the outer spindle 22 and the outer handle 21 is not possible in this locked state. Nevertheless, the user may either turn the inner handle 11 from inside or use a tool to turn the drive portion 411 of the outer unlatching rod 41 from outside for achieving the unlatching function.

Figure 8:
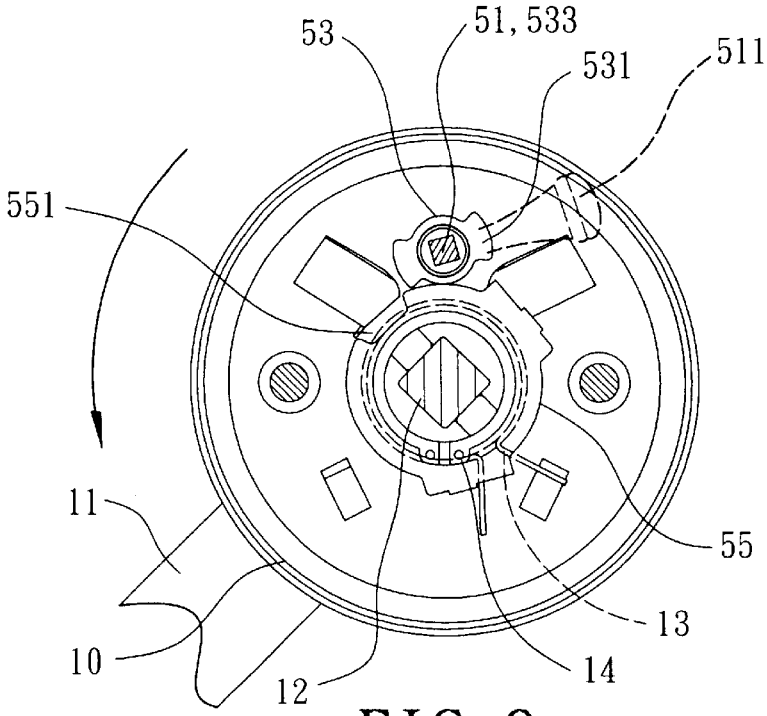
FIG. 8 is a view similar to FIG. 7, illustrating unlatching operation of the lock in accordance with the present invention.

Referring to FIGS. 3, 6, and 8, owing to the provision of the truncated conic unlatching groove 523 of the fixing member 52 that occupies an area much larger than the size of the engaging block 531 of the locking wheel 53, the unlatching function can be achieved through turning the inner handle 11 through 40–60 degrees, preferably 45 degrees. Namely, the inner spindle 12, the wheel 55, and the locking wheel 53 are turned through, e.g., 45 degrees, which is sufficient to move the engaging block 531 of the locking wheel 53 into the unlatching groove 522 of the fixing member 52 and to move the locking wheel 53 out of the engaging groove 551 of the wheel 55. Thus, even if the inner handle 11 is returned under the action of the elastic element 13 to its original position before it is turned through 90 degrees, the wheel 55 would not cause the engaging block 531 of the locking wheel 53 to move back into the locking groove 523 of the fixing member 52. Thus, the risk of inadvertent locking of the bathroom is reduced. Further, the truncated conic wall 524 of the fixing member 52 improves the strength of the fixing member 52, and the protrusion 525 of the fixing member 52 provides a simplified positioning of the fixing member 52. Further, the arcuate drive portions 532 of the locking wheel 53 simplifies the unlatching mechanism associated with the wheel 55. The utility of the bathroom lock in accordance with the present invention is increased and the service life of the bathroom lock in accordance with the present invention is prolonged.

While the principles of this invention have been disclosed in connection with its specific embodiment, it should be understood by those skilled in the art that these descriptions are not intended to limit the scope of the invention, and that any modification and variation without departing the spirit of the invention is intended to be covered by the scope of this invention defined only by the appended claims.

Number List

| | | | |
|---|---|---|---|
| 10 | inner rose | 20 | outer rose |
| 101 | inner housing | 201 | outer housing |
| 102 | hole | 103 | groove |

-continued

Number List

| | | | |
|---|---|---|---|
| 11 | inner handle | 21 | outer handle |
| 12 | inner spindle | 22 | outer spindle |
| 13 | elastic element | 14 | retainer ring |
| 120 | drive wheel | 121 | groove |
| 202 | hole | 203 | plates |
| 30 | inner unlatching mechanism | | |
| 31 | inner unlatching rod | | |
| 32 | fixing member | 321 | hole |
| 322 | unlatching notch | 323 | locking notch |
| 33 | locking wheel | 331 | engaging block |
| 332 | teeth | 333 | non-circular hole |
| 34 | elastic element | 35 | follower wheel |
| 351 | notch | 352 | teeth |
| 40 | outer unlatching mechanism | | |
| 41 | outer unlatching rod | 411 | drive portion |
| 412 | rectangular hole | 42 | elastic element |
| 43 | stop plate | 431 | protrusion |
| 432 | hole | 433 | pin |
| 44 | locking plate | | |
| 441 | locking groove | 442 | unlatching groove |
| 443 | non-circular hole | | |
| 45 | wheel | 451 | engaging groove |
| 50 | inner unlatching mechanism | | |
| 51 | inner unlatching rod | 511 | arm |
| 52 | fixing member | 521 | central through-hole |
| 522 | unlatching groove | 523 | locking groove |
| 524 | truncated conic wall | 525 | protrusion |
| 53 | locking wheel | 531 | engaging block |
| 532 | arcuate drive portion | 533 | non-circular hole |
| 54 | elastic element | | |
| 55 | follower wheel | 551 | notch |
| 552 | protrusion | | |

What is claimed is:

1. A lock structure for bathroom use, comprising an inner rose (10), an outer rose (20), an inner unlatching mechanism (50), and an outer unlatching mechanism (40), an inner spindle (12) rotatably extending through the inner rose, with an inner handle (11) being attached to the inner spindle to turn therewith, an outer spindle (22) rotatably extending through the outer rose, with an outer handle (21) being attached to the outer spindle to turn therewith, the inner unlatching mechanism (50) comprising:

an inner unlatching rod (51) having a non-circular section, the inner unlatching rod (51) being operably connected to the outer unlatching mechanism (40);

a fixing member (52) fixed to the inner rose (10) and mounted around the inner unlatching rod (51), the fixing member (52) including a first side, a second side, and a central hole (521) through which the inner unlatching rod (51) rotatably extends, an unlatching groove (522) being defined in the first side of the fixing member and tapering to the central through-hole (521), the unlatching groove (522) being delimited by a truncated conic wall (524), a locking groove (523) being defined in an end edge of the first side of the fixing member and spaced from the unlatching groove (522), the locking groove (523) having a depth along a longitudinal direction of the inner unlatching rod (51) not equal to a depth of the unlatching groove (522) along the longitudinal direction of the inner unlatching rod;

a locking wheel (53) mounted to the inner unlatching rod (51) to turn therewith, the locking wheel (53) including an engaging block (531) for selectively engaging with one of the unlatching groove (522) and the locking groove (523) of the fixing member (52), the locking wheel (53) further including an arcuate drive portion (532) on an outer periphery thereof; and a follower wheel (55) securely mounted around the inner spindle (12) to turn therewith, the follower wheel (55) including a notch (551) for releasably engaging with the arcuate drive portion (532) of the locking wheel (53);

wherein when in a locked state, the engaging block (531) of the locking wheel (53) is engaged in the locking groove (523) of the fixing member (52), and the arcuate drive portion (532) of the locking wheel (53) is engaged in the notch (551) of the follower wheel (55), with the outer unlatching mechanism (40) being in a state not allowing rotational movement of the outer spindle (22) and the outer handle (21); and wherein when the inner handle (11) is turned to turn the inner spindle (22) through 40–60 degrees, the engaging block (531) of the locking wheel (53) is moved into the unlatching groove (522) of the fixing member (52), and the arcuate drive portion (532) of the locking wheel (53) is disengaged from the notch (551) of the follower wheel (55).

2. The lock structure for bathroom use as claimed in claim 1, wherein the unlatching groove (522) of the fixing member (52) has a width greater than that of the engaging block (531) of the locking wheel (53), and wherein the unlatching groove (522) of the fixing member (52) has a length greater than that of the engaging block (531) of the locking wheel (53).

3. The lock structure for bathroom use as claimed in claim 1, wherein the inner unlatching mechanism (50) further includes an elastic element (54) mounted around the inner unlatching rod (51) for biasing the fixing member (52) to press against the inner rose (10) and for biasing the engaging block (531) of the locking wheel (53) to be selectively engaged in one of the unlatching groove (522) and the locking groove (523) of the fixing member (52).

4. The lock structure for bathroom use as claimed in claim 3, wherein the inner rose (10) includes a hole (102) through which the inner unlatching rod (51) is rotatably extended, a groove (103) being defined in an inner periphery defining the hole (102) of the inner rose (10), the fixing member (52) further including a protrusion (525) on the second side thereof, the protrusion (525) of the fixing member (52) being securely engaged in the hole (102) of the inner rose (10).

5. The lock structure for bathroom use as claimed in claim 1, wherein the inner unlatching rod (51) has an end extending beyond the inner rose (10), with an arm (511) being attached to the end of the inner unlatching rod (51).

6. The lock structure for bathroom use as claimed in claim 1, wherein the locking wheel (53) further includes another arcuate drive portion (532) located on the outer periphery of the locking wheel (53) and diametrically opposed to the arcuate drive portion (532).

7. The lock structure for bathroom use as claimed in claim 1, wherein the outer rose (20) has a hole (202) and a pair of plates (203) on both sides of the hole (202), the outer unlatching mechanism (40) including:

an outer unlatching rod (41) extending through the hole (202) of the outer rose (20), the outer unlatching rod (41) having a non-circular hole (412) for securely receiving an end of the inner unlatching rod (5 1) to turn therewith, the outer unlatching rod further having a drive portion (411) located outside a door to which the lock structure is mounted so that the drive portion (411) is drivable by a tool to turn the outer unlatching rod (41) for unlatching;

a stop plate (43) mounted on the outer unlatching rod (41) and slidable yet not rotatable along a longitudinal axis of the outer unlatching rod (41), the stop plate (43) being located between the plates (203) of the outer rose (20) and having a protrusion (431) and a hole (432) through which the outer unlatching rod (41) extends;

a locking plate (44) mounted to the outer unlatching rod (41) to turn therewith, the locking plate (44) having a locking groove (441) that has a depth along a longitudinal axis of the outer unlatching rod (41) and an unlatching groove (442) that has a depth along the longitudinal axis of the outer unlatching rod (41) not equal to the depth of the locking groove (441) of the locking plate (44), the protrusion (431) of the stop plate (43) being selectively engaged in one of the locking groove (441) and the unlatching groove (442) of the locking plate (44); and a wheel (45) securely mounted to the outer rose (20) to turn therewith and having an engaging groove (451);

wherein when in the locked state, the protrusion (431) of the stop plate (43) is engaged in the locking groove (441) of the locking plate (44), and the stop plate (43) is engaged in the engaging groove (451) of the wheel (45), and wherein when the inner handle (11) is turned for unlatching purposes, the locking plate (44) is so turned that the protrusion (431) of the stop plate (43) is moved into the unlatching groove (442) of the locking plate (44) and that the stop plate (43) is engaged from the engaging groove (451) of the wheel (45), allowing free rotation of the outer spindle (22) and the outer handle (21).

8. The lock structure for bathroom use as claimed in claim 1, wherein the fixing member (52) further has another locking groove (523) defined in another end edge of the first side of the fixing member that is opposed to the end edge of the first side of the fixing member.

* * * * *